US010210782B2

(12) United States Patent
Lee et al.

(10) Patent No.: US 10,210,782 B2
(45) Date of Patent: Feb. 19, 2019

(54) DISPLAY DEVICE INCLUDING CRACK DETECTION LINE

(71) Applicant: SAMSUNG DISPLAY CO., LTD., Yongin-si, Gyeonggi-do (KR)

(72) Inventors: Seung-Kyu Lee, Asan-si (KR); Tae Hoon Kwon, Yongin-si (KR); Ji-Hyun Ka, Asan-si (KR); Won Kyu Kwak, Seongnam-si (KR); Dong Soo Kim, Seoul (KR); Han-Sung Bae, Seongnam-si (KR); Hey Jin Shin, Cheonan-si (KR); Seung Ji Cha, Seoul (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 0 days.

(21) Appl. No.: 15/455,425

(22) Filed: Mar. 10, 2017

(65) Prior Publication Data

US 2018/0033354 A1 Feb. 1, 2018

(30) Foreign Application Priority Data

Aug. 1, 2016 (KR) ..... 10-2016-0098174

(51) Int. Cl.
*G09G 3/00* (2006.01)

(52) U.S. Cl.
CPC ..... *G09G 3/006* (2013.01); *G09G 2300/0426* (2013.01); *G09G 2330/12* (2013.01); *G09G 2380/02* (2013.01)

(58) Field of Classification Search
None
See application file for complete search history.

(56) References Cited

U.S. PATENT DOCUMENTS

2014/0176844 A1 6/2014 Yanagisawa

FOREIGN PATENT DOCUMENTS

| | | | |
|---|---|---|---|
| EP | 2 983 157 | | 8/2015 |
| EP | 3 098 869 | | 5/2016 |
| JP | 2013-011663 | A | 1/2013 |
| JP | 2014-122974 | A | 7/2014 |
| KR | 10-2007-0082867 | A | 8/2007 |
| KR | 10-2013-0136806 | A | 12/2013 |

OTHER PUBLICATIONS

Extended European Search Report dated Aug. 2, 2017, of the corresponding European Patent Application No. 17170542.9.

*Primary Examiner* — Gustavo Polo
(74) *Attorney, Agent, or Firm* — Lee & Morse P.C.

(57) ABSTRACT

A display device includes a peripheral area around a display area, a plurality of pixels in the display area, and a plurality of signal lines connected to the pixels. The signal lines include a plurality of data lines connected to the pixels, a crack detection line connected to first data lines among the data lines through a first transistor, and a control line connected to a gate of the first transistor. The crack detection line is in the peripheral area.

21 Claims, 11 Drawing Sheets

DISPLAY DEVICE INCLUDING CRACK DETECTION LINE

CROSS-REFERENCE TO RELATED APPLICATION

Korean Patent Application No. 10-2016-0098174, filed on Aug. 1, 2016, and entitled, "Display Device," is incorporated by reference herein in its entirety.

BACKGROUND

1. Field

One or more embodiments described herein relate to a display device.

2. Description of the Related Art

Display devices continue to get thinner and more compact. As a result, they are more susceptible to being damaged by cracks, scratches, or external impact. If a display device is cracked, moisture or foreign particles may seep into the display area. This may cause a malfunction.

SUMMARY

In accordance with an embodiment, a display device a substrate including a peripheral area around a display area, a plurality of pixels in the display area of the substrate, and a plurality of signal lines on the substrate and connected to the pixels, wherein the signal lines include a plurality of data lines connected to the pixels, a crack detection line connected to first data lines among the data lines through a first transistor, the crack detection line in the peripheral area, and a control line connected to a gate of the first transistor. The first transistor may be in the peripheral area.

The display device may include a plurality of data pads in the peripheral area and connected to the data lines, each data pad to transfer a data voltage to be applied to the pixels, wherein the first transistor is in an area between the data pads and the data lines. The crack detection line may be a wire that runs around the display area. The crack detection line may be in a zigzag pattern along one edge of the display area. The crack detection line may be connected to a first voltage pad that is to apply a black grayscale-level voltage. The crack detection line and the data lines may be on different layers.

The signal lines may include a test voltage line connected to second data lines through a second transistor, wherein the second data lines are different from the first lines. The test voltage line may have a resistance value corresponding to a resistance value of the crack detection line. A resistance value of the test voltage line may be proportional to an intensity of a resistance value of the crack detection line and a number of the first data lines and may be inversely proportional to a number of the second data lines. The crack detection line and the test voltage line may be on a same layer. The test voltage line may be connected to a first voltage pad which is to apply a black grayscale-level voltage. The control line may be connected to a gate of the second transistor.

In accordance with one or more other embodiments, a display device includes a display area; a non-display area; and a crack detection line extending from the non-display area to the display area, wherein the crack detection line is connected to an internal data line between first and last data lines in the display area. The crack detection line may be connected to a test voltage pad. The display device may include a transistor, wherein the crack detection line is connected to the internal data line through the transistor. The transistor may have a gate connected to a test control pad. The transistor may be in the non-display area.

BRIEF DESCRIPTION OF THE DRAWINGS

Features will become apparent to those of skill in the art by describing in detail exemplary embodiments with reference to the attached drawings in which.

DETAILED DESCRIPTION

Figure 1A:
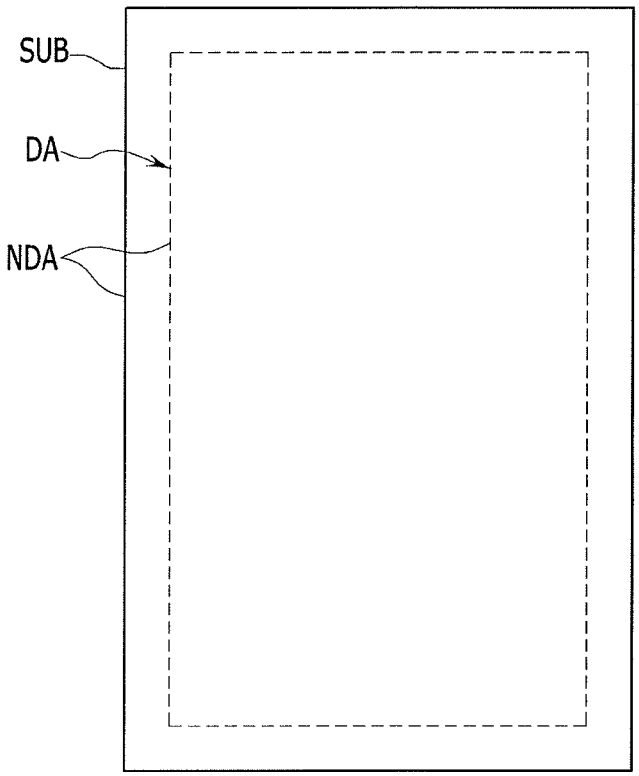
FIG. 1A illustrates an embodiment of a display device.

Example embodiments will now be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 1B:
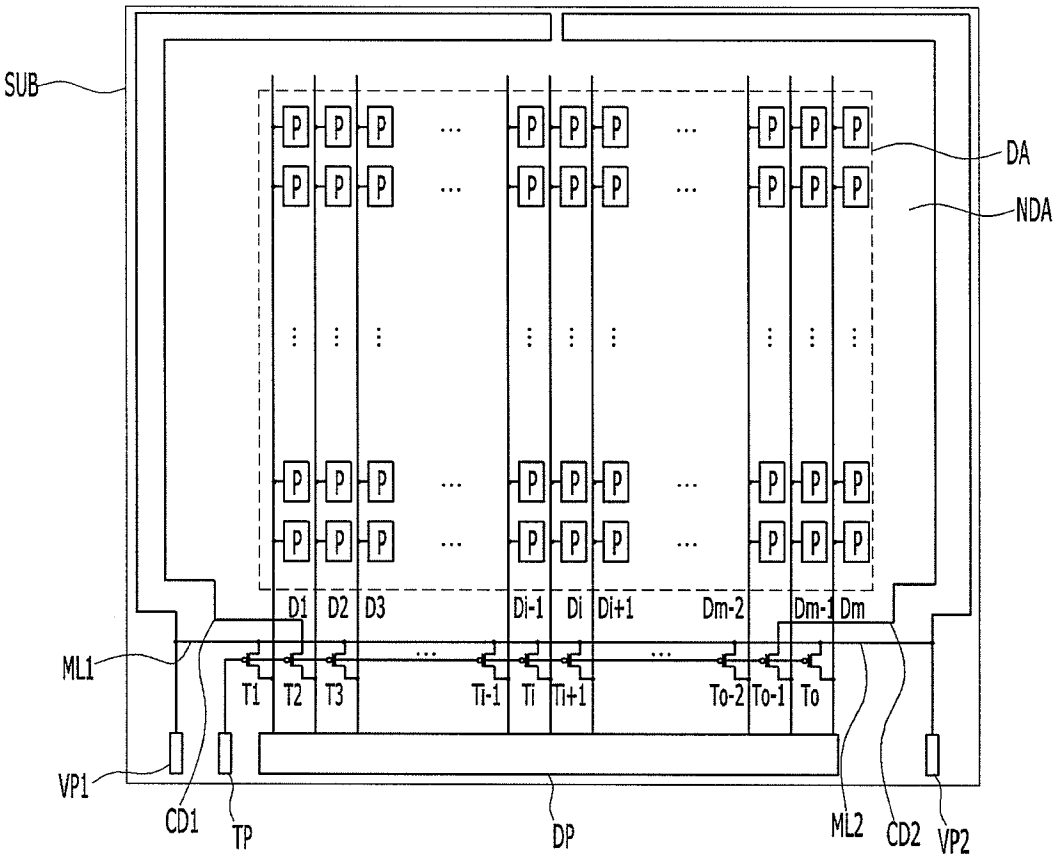
FIG. 1B illustrates an embodiment of an internal structure of the display device in FIG. 1A.

FIGS. 1A and 1B recite an embodiment of a display device. More specifically, FIG. 1A is a top plan view of the display device and FIG. 1B illustrates an embodiment of an internal structure of the display device.

Referring to FIG. 1A, the display device includes a substrate SUB, a display area DA to display an image, and a peripheral area NDA surrounding the display area DA. The substrate SUB is an insulating substrate including, for example, glass, polymers, or stainless steel. The substrate SUB may be flexible, stretchable, foldable, bendable, or rollable, to allow the display device to be flexible, stretchable, foldable, bendable, or rollable. In one embodiment, the substrate SUB may include or be a flexible film including a resin such as a polyimide resin.

The peripheral area NDA is illustrated to surround the display area DA. In one embodiment, the peripheral area NDA may be on lateral sides of the display area DA or on one lateral side. In FIG. 1B, the display area DA of the substrate SUB includes a plurality of data lines D1 to Dm connected to a plurality of pixels P. A pixel P may be the smallest unit that emits light to display an image. The pixels P may be arranged in rows in the display area DA.

A data pad DP, test voltage pads VP1 and VP2, a test control pad TP, and test transistors T1 to To are in the peripheral area NDA of the substrate SUB. The data pad DP is connected to the data lines D1 to Dm to supply data signals to the pixels P.

The test voltage pads VP1 and VP2 are connected to one end of each of the test transistors T1 to To. Predetermined test voltages are applied to the test voltage pads VP1 and VP2. In one embodiment, the same or different test voltages may be supplied to the test voltage pads VP1 and VP2.

The test control pads TP are connected to respective gates of the test transistors T1 and To. Predetermined test control signals are supplied to the test control pads TP. In one embodiment, the same or different test control signal may be supplied to the test control pads TP.

The test transistors T1 to To may be between the display area DA and the data pad DP in the peripheral area NDA. The test transistors T1 to To are connected between the data lines D1 to Dm and the test voltage pads VP1 and VP2.

Crack detection lines CD1 and CD2 may be respectively connected between one end of the test transistors T2 and To-1 from among the test transistors T1 to To and their corresponding test voltage pads VP1 and VP2.

Test voltage lines ML1 and ML2 may be connected between the test voltage pads VP1 and VP2 and one end of each of the test transistors T1, T3 to To-2, and To not connected to the first and second crack detection lines CD1 and CD2.

Each of the first and second crack detection lines CD1 and CD2 may be a wire that runs around the circumference or other predetermined area of the display area DA. For example, the first crack detection line CD1 may be on the left outside of the display area DA, and the second crack detection line CD2 may be on the right outside of the display area DA.

Figure 2:
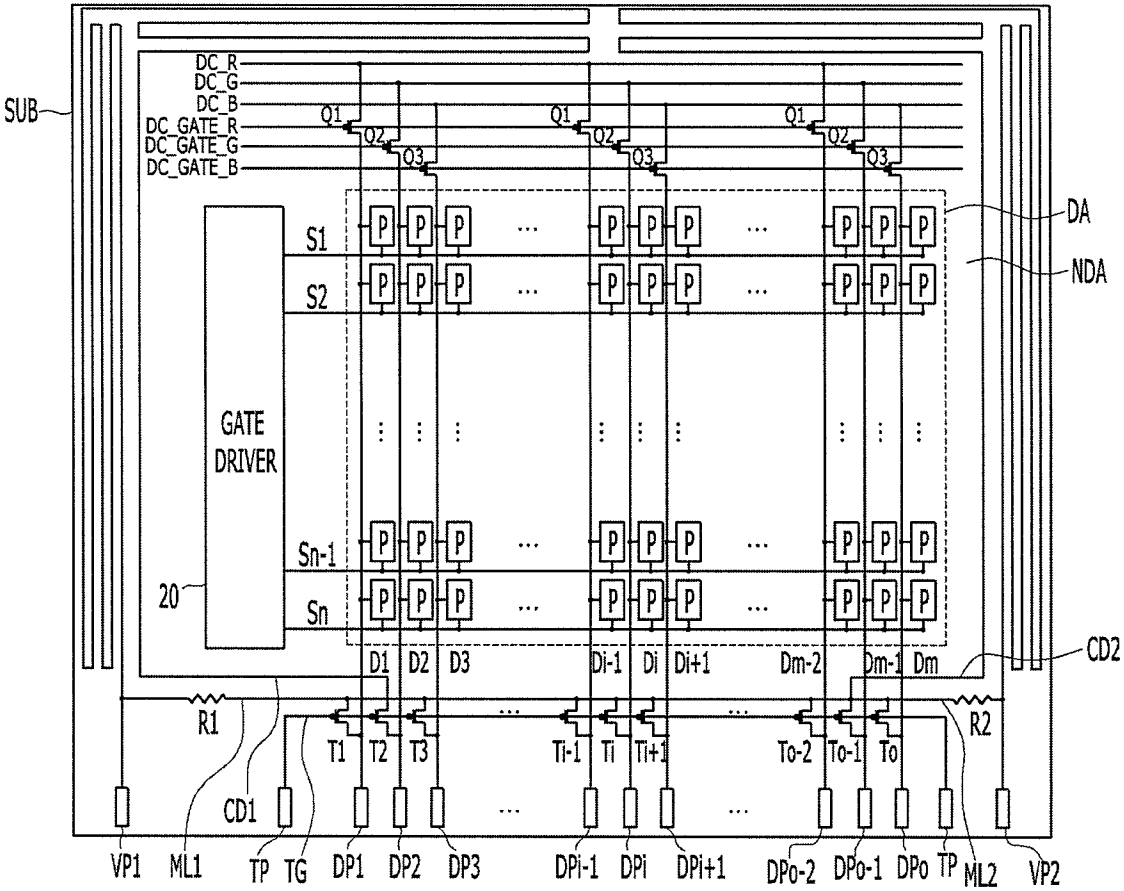
FIG. 2 illustrates another embodiment of a display device.

FIG. 2 illustrates an embodiment of a display which device includes a display area DA including a plurality of pixels P and a peripheral area NDA surrounding the display area DA. A plurality of signal lines include gate lines S1 to Sn and data lines D1 to Dm. The gate lines S1 to Sn and the data lines D1 to Dm are in the display area DA of a substrate SUB and the first crack detection line CD1 is in the peripheral area The signal lines may further include a plurality of DC voltage lines DC_R, DC_G, and DC_B, and a plurality of DC control lines DC_GATE_R, DC_GATE_G, and DC_GATE_B. In one embodiment, the peripheral area NDA in which the first and second crack detection lines CD1 and CD2 are disposed may bend.

Data pads DP1 to DPo (o is a positive integer equal to or greater than m), switching elements Q1, Q2, and Q3, test voltage pads VP1 and VP2, test control pads TP, and test transistors T1 to To may be in peripheral area NDA of substrate SUB. The data pads DP1 to DPo are connected to the data lines D1 to Dm.

The display device may further include a source drive IC connected to the data pads DP1 to DPo. For example, the source drive IC may supply data voltages to the data pads DPI to DPo. Therefore, the data lines D1 to Dm may receive the data voltages.

The test control pads TP are connected to respective gates of the test transistors T1 to To. The test control pads TP receive a test control signal.

The test voltages pads VP1 and VP2 are connected to one end of each of the test transistors T1 to To. The test voltage pads VP1 and VP2 may receive same test voltage.

The test transistors T1 to To are in the peripheral area NDA and, for example, may be between the display area DA and the data pads DPi to DPo in the peripheral area NDA. The test transistors T1 to To are connected between the data lines D1 to Dm and the test voltage pads VP1 and VP2. Gates TG of the test transistors T1 to To are connected to the test control pads TP.

The respective gates TG of the test transistors T1 to To may be connected to the test control pads TP. Each of the test transistors T1 to To may include one end connected to the test voltage pads VP1 and VP2 and another end connected to a respective one of the data lines D1 to Dm.

The crack detection lines CD1 and CD2 may be between one end of the test transistors T2 and To-1 from among the test transistors T1 to To and corresponding ones of the test voltages pads VP1 and VP2. The first crack detection lines CD1 may be between one end of the test transistor T2 connected to a data line D2 and the test voltage pad VP1. The second crack detection line CD2 may be between one end of the test transistor To-1 connected to a data line Dm-1 and the test voltage pad VP2.

Each of the first and second crack detection lines CD1 and CD2 may be in the peripheral area NDA outside the display area DA. When a gate driver 20 is in the peripheral area NDA along one edge of the display area DA, the first and second crack detection lines CD1 and CD2 may arranged a greater distance away from the display area DA than the gate driver 20.

The first crack detection line CD1 may run around to the left outside the display area DA. The second crack detection line CD 2 may run around to the right outside the display area DA. The first crack detection line CD1 may be a wire aligned in a predetermined (e.g., zigzag) pattern along one edge of the display area DA. The second crack detection line CD2 may be a wire aligned in a predetermined (e.g., zigzag) pattern along another edge of the display area DA. A crack detection line may be a single wire that runs partially or entirely around the circumference of the display area DA and/or in another predetermined area.

Resistors (or other resistive elements) R1 and R2 may be in the peripheral area NDA. The resistors R1 and R2 may be in the first test voltage line ML1 or the second test voltage line ML2. The resistors R1 and R2 may compensate for a difference between a test voltage value applied to the data lines D2 and Dm-1 and a test voltage value applied to the data lines D1, D3 to Dm-2, and Dm. The difference may occur as a result of resistance of the first and second crack detection lines CD1 and CD2.

In one embodiment, the resistors R1 and R2 may be connected to the first and second test voltage lines ML1 and ML2, which connect the test voltage pads VP1 and VP2 with one end of each of the test transistors T1, T3 to To-2, and To not connected to the first and second crack detection lines CD1 and CD2. The value of the resistor R1 may be set based on the value of the resistance of the crack detection line CD1, to reduce or minimize variation in voltages which occur due to the resistance of the crack detection line CD1.

In one embodiment, the value of resistor R1 may be set based on Equation 1.

$$R = \frac{R_{CD}}{k} \times T \times 1.25 \quad (1)$$

where R denotes a value of the resistance R1, RCD denotes a value of resistance of the crack detection line CD1, k denotes the number of data lines connected to the first test voltage line ML1, and T denotes the number of data lines connected to the crack detection line CD1. In Equation 1, the value of 1.25 is a constant which may be changed to another value, e.g., an integer greater than 0.

The resistance R1 may be set by changing the form of the first test voltage line ML1 within an area where the first test voltage line ML1 is disposed. For example, the thickness, length, and/or width of the first test voltage line ML1 may be adjusted to form resistance R1 which satisfies a resistance value calculated from Equation 1. Since the first test voltage line ML1 is in an area between the test voltage pad VP1 and one end of test transistor T1, there is sufficient area to secure the resistor R1. The value of resistor R2 may be set in a manner similar to the way in which resistor R1 is set.

Each a plurality of first switching elements Q1 may have one terminal connected to a corresponding DC voltage DC_R, another terminal connected to a corresponding data line, and a gate connected to a DC control line DC_GATE_R.

Each of a plurality of second switching elements Q2 may have one terminal connected to a corresponding DC voltage line DC_G, another terminal connected to a corresponding data line, and a gate connected to a DC control line DC_GATE_G.

Each of a plurality of third switching elements Q3 may have one terminal connected to a corresponding DC voltage line DC_B, another terminal connected to a corresponding data line, and a gate connected to a DC control line DC_GATE_B.

In the embodiment in FIG. 2, the switching elements Q1, Q2, and Q3, the DC voltage lines DC_R, DC_G, and DC_B, and the DC control lines DC_GATE_R, DC_GATE_G, and DC_GATE_B are on the upper portion of the peripheral area NDA. The data pads DP1 to DPo, the test control pads TP, the test voltage pads VP1 and VP2, the test transistors T1 to To, and the resistors R1 and R2 are on the lower portion of the peripheral area NDA. The arrangement of the signal lines, pads, transistors, and resistances in the peripheral area NDA may be different in another embodiment.

Figure 3:
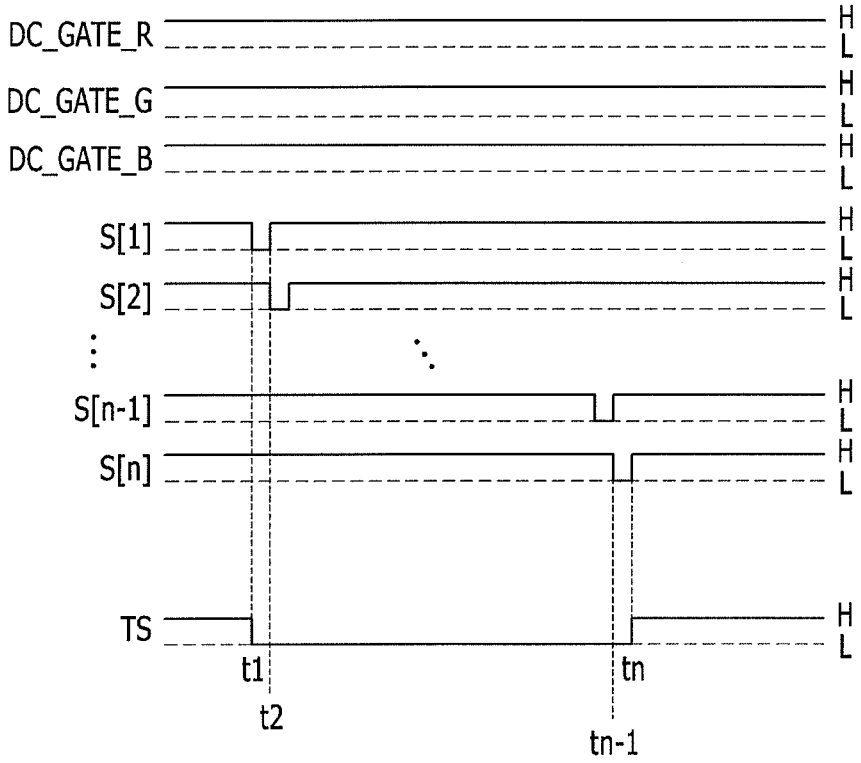
FIG. 3 illustrates signals for a display device according to an embodiment.

FIG. 3 illustrates an embodiment of signals that may applied to a display device of one or more of the aforementioned embodiments. The signals include control signals DC_GATE_R, DC_GATE_G, and DC_GATE_B applied to DC control lines DC_GATE_R, DC_GATE_G, DC_GATE_B, a test control signal TS applied to test control pads TP, and scanning signals S[1] to S[n].

Referring to FIG. 3, the control signals DC_GATE_R, DC_GATE_G, and DC_GATE_B remain at a disable level (H) during a time period between t1 and tn when the test control signal TS is at an enable level (L). If the test control signal TS is at the enable level (L), test transistors T1 to To may be turned on. A test voltage may be at a voltage level corresponding to a predetermined (e.g., black) grayscale level. For example, the test voltage may be at the disable level (H). The test voltage may be supplied to the data lines D1 to Dm through the turned-on transistors T1 to To.

The scanning signals S[1] to S[2] may be sequentially changed to be at the enable level (L) during the time period t1 to tn at which the test control signal TS is at the enable level (L). For example, the scanning signal S[1] may have the enable level (L) at t1 and the disable level (H) at t2. Then, the scanning signal S[2] is at the enable level (L) at t2. The scanning signals S[1] to S[n] are supplied to the pixels P, and the test voltages are written to the pixels P. A pixel P is able to display a black grayscale level based on the written test voltage.

Figure 4:
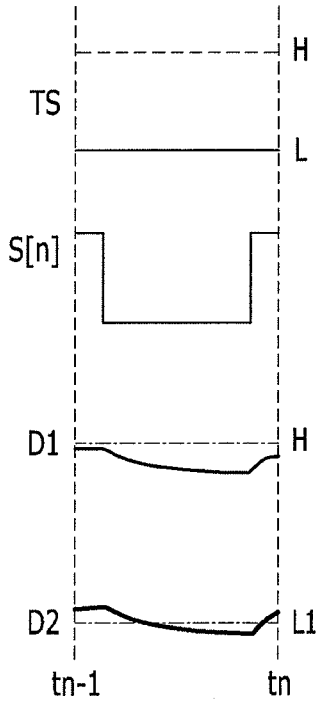
FIG. 4 illustrates more details of the signals in FIG. 3.
Figure 5:
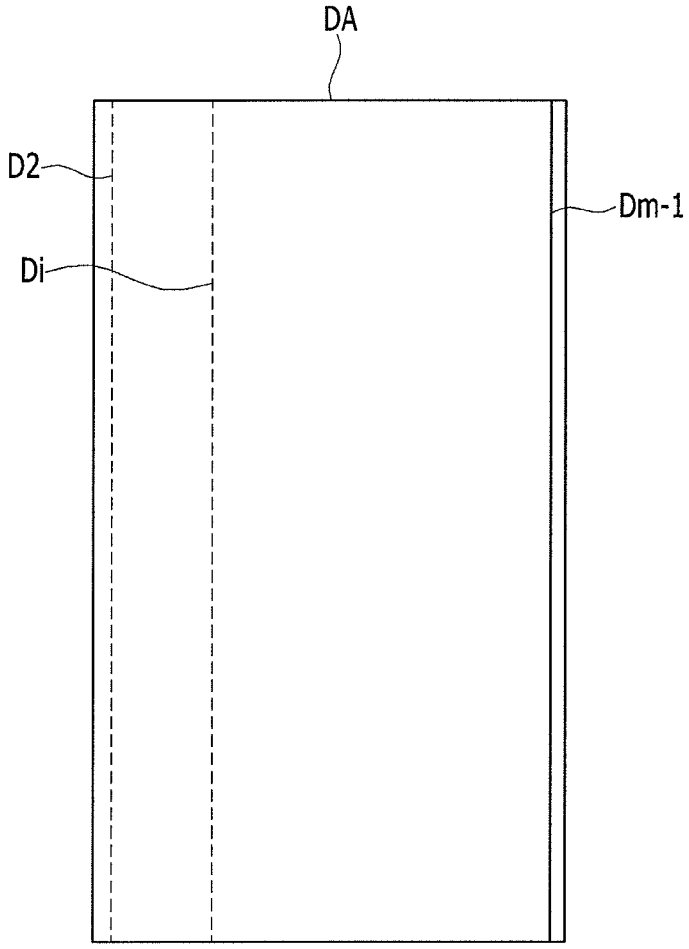
FIG. 5 illustrates an embodiment of a display area of a display device to which a test signal is applied.

FIGS. 3, 4, and 5 illustrate an embodiment of a crack inspection method for a display device. FIG. 4 illustrates an embodiment of waveforms in FIG. 3, and FIG. 5 illustrating an embodiment of a display area to which a test signal is applied.

Referring to FIG. 4, if a scanning signal S[n] is changed to be at the enable level (L) in a period between tn-1 and tn, a test voltage at a disable level (H) may be applied to a data line D1. Therefore, a pixel connected to the data line D1 displays a black grayscale level.

However, if the display device is cracked, data lines D1 to Dm or first and second crack lines CD1 and CD2 may be disconnected, or resistance of the data lines D1 to Dm or resistance of the first and second crack lines CD1 and CD2 may increase. For example, if a data line D2 or the first crack detection line CD1 is disconnected due to a crack in the display device, a test voltage is not supplied to the data line D2.

In another case, if resistance of the data line D2 or the first crack detection CD1 is increased due to a crack in the display device, the test voltage to be applied to the data line D2 may be at a predetermined level L1 lower than the disable level, because the voltage drops due to the increase in resistance. Therefore, the voltage supplied to a pixel which is connected to the data line D2 and supplied with the scanning signal S[n] in the period between tn-1 and tn may have a level L1 lower than the disable level (H).

As a result, a voltage at the low level (L1) is applied to the pixel connected to the data line D2. The pixel connected to the data line D2 may emit light of a white or gray grayscale level based on the low level (L1) voltage. Thus, a bright line may appear as a result of the pixels connected to the data line D2.

As illustrated in FIG. 5, the pixels connected to the data line D2, to which a test voltage is applied from the crack detection line CD1, may emit light of a white or gray grayscale level. Thus, a bright line (illustrated as a dotted line) may appear. In this case, it may be determined that a crack has occurred in a portion of the peripheral area including the first crack detection line CD1.

In one embodiment, a data line Di connected to a test transistor Ti not connected to the first and second crack detection lines CD1 and CD2 may be illustrated as a dotted line. This case may also be considered to correspond to a crack in the display device.

In addition, pixels connected to a data line Dm-1, to which a test voltage is applied from the second crack detection line CD2, may display a black grayscale level. Thus, a dark line (illustrated as a solid line) may appear. In this case, the portion of the peripheral area NDA including the second crack detection line CD2 may be determined not to be cracked.

Thus, the present embodiment enables detection of of a crack in a display device based on a disconnection or variation in resistance of the data lines D1 to Dm and based on a disconnection or variation in resistance of the crack detection lines outside the display area DA. Thus, if a bright line appears in the data lines, to which a test voltage is applied from the crack detection lines, it is possible to determine that the display device is cracked.

Figure 6:
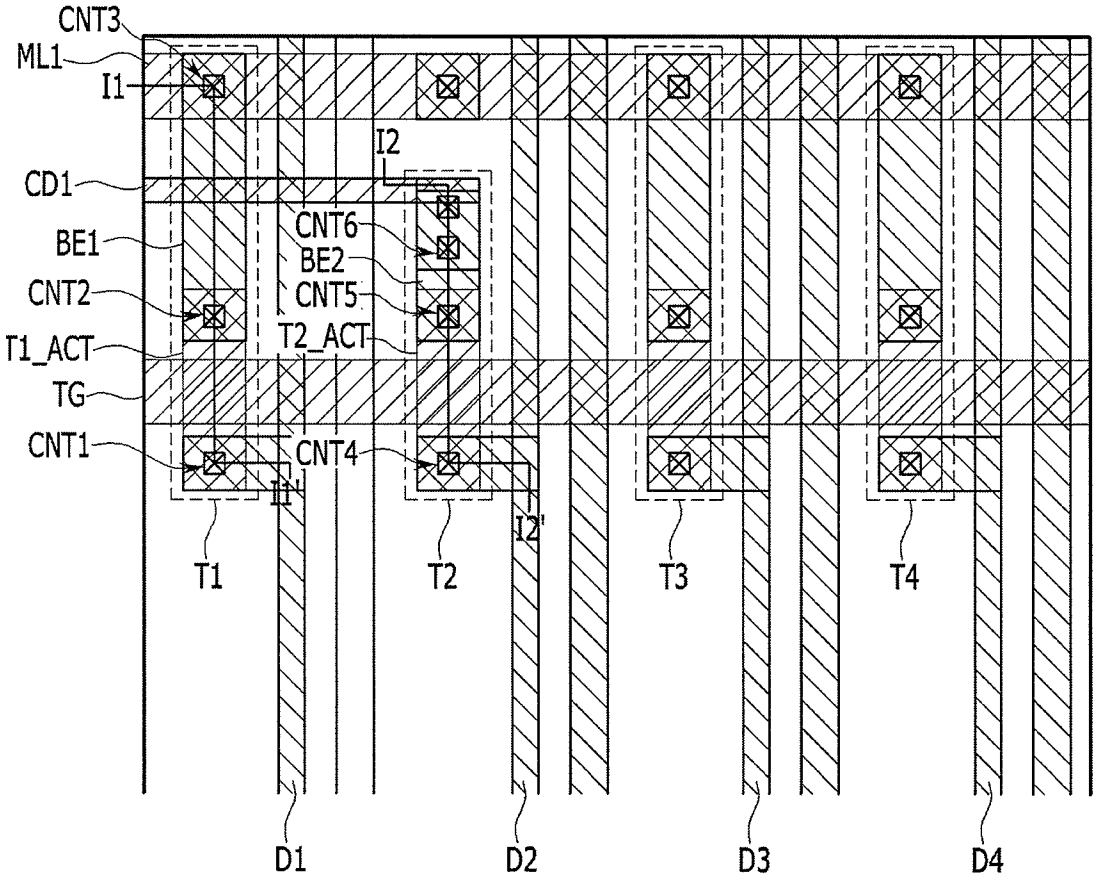
FIG. 6 illustrates an embodiment of a connection structure between test transistors, data lines, crack detection lines, and test voltage lines.
Figure 7:
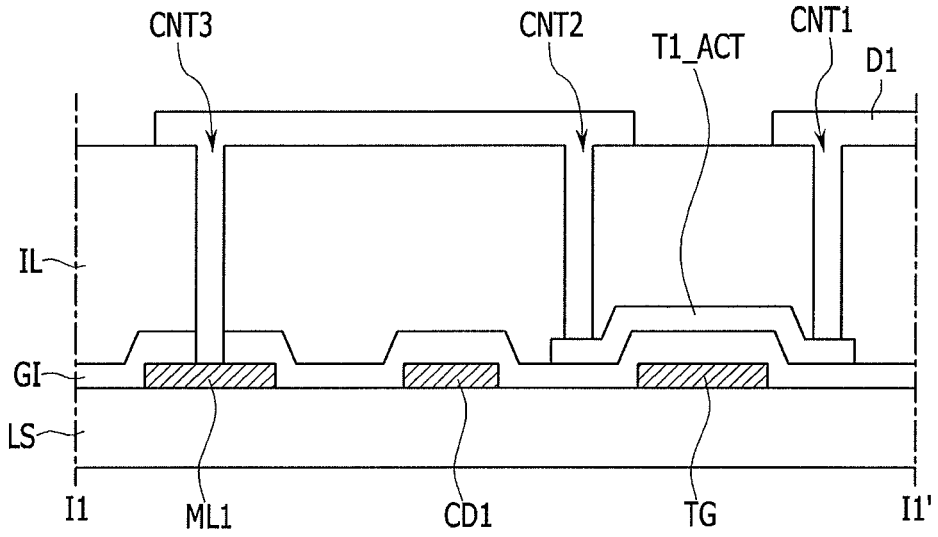
FIG. 7 illustrates a cross-sectional view taken along line I1-I1' in FIG. 6.
Figure 8:
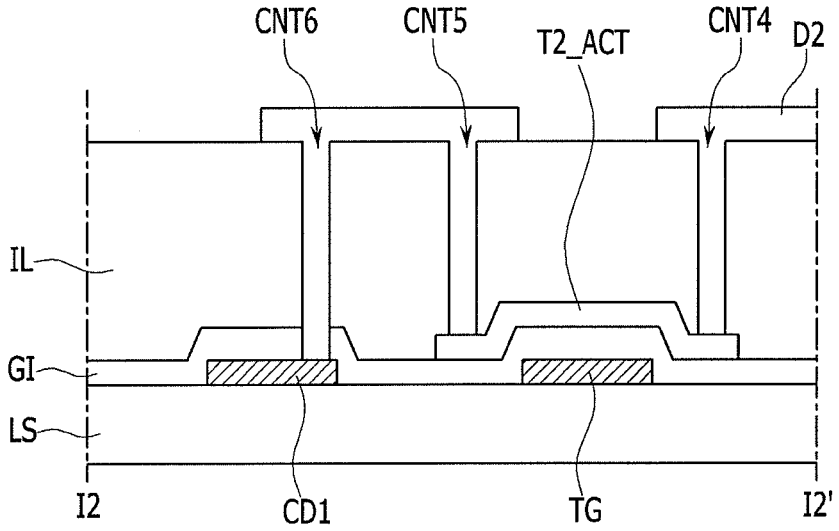
FIG. 8 illustrates a cross-sectional view taken along line I2-I2' in FIG. 6.

FIGS. 6 to 8 illustrate an embodiment of a connection structure of a test transistor and a data line, the connection structure of a test transistor and a crack detection line, and the connection structure of a test transistor and a test voltage line in a display device. More particularly, FIG. 6 illustrates a top plan view of the connection structure between test transistors, data lines, crack detection lines, and test voltage lines. FIG. 7 illustrates a cross-sectional view taken along line IMF of FIG. 6. FIG. 8 illustrates a cross-sectional view taken along line I2-I2' in FIG. 6.

FIG. 6 illustrates four test transistors T1, T2, T3, and T4 connected to four data lines D1, D2, D3, and D4. Each of the test transistors T3 and T4 may have the same configuration as the test transistor T2.

Referring to FIGS. 6 and 7, a predetermined area of a gate TG of the transistor T1 overlaps an active layer T1_ACT of the transistor T1. The active layer T1_ACT of the transistor T1 has one end connected to the data line D1 through a first contact hole CNT1 and another end connected to a connection electrode BE1 through a second contact hole CNT2. The connection electrode BE1 is connected to one end of a first test voltage line ML1 through a third contact hole CNT3. The first test voltage line ML1 is connected to a test voltage pad VP1 through a resistance R1.

The gate TG of the transistor T1 and the first test voltage line ML1 may be formed in a first metal pattern. The active layer T1_ACT of the transistor T1 may be formed in a semiconductor pattern. The data line D1 and the connection electrode BE1 may be formed in a second metal pattern.

Referring to FIGS. 6 and 8, a predetermined area of a gate TG of the transistor T2 overlaps an active layer T2_ACT of the transistor T2. The active layer T2_ACT of the transistor T2 has one end connected to the data line D2 through a fourth contact hole CNT4 and another end connected to a connection electrode BE2 through a fifth contact hole CNT5. The connection electrode BE2 is connected to one end of the crack detection line CD1 through a sixth contact hole CNT6. The crack detection line CD1 may run, entirely or partially, around the circumference of the display area DA, fore example, as in FIG. 2. Another end of the crack detection line CD1 may be connected to the test voltage pad VP1.

The gate TG of the transistor T2 and the crack detection line CD1 may be formed in a first metal pattern. The active layer T2_ACT of the transistor T2 may be formed in a semiconductor pattern. The data line D2 and the connection electrode BE2 may be formed in a second metal pattern.

The first metal pattern may be a gate metal pattern and the second metal pattern may be a source/drain metal pattern. The semiconductor pattern may include polysilicon. In one embodiment, the semiconductor pattern may include monocrystalline silicon, amorphous silicon, an oxide semiconductor material, or another material. A gate insulator GI may be formed between the first metal pattern and the semiconductor pattern to insulate the first metal pattern and the semiconductor pattern. An insulating layer IL may be formed between the semiconductor pattern and the second metal pattern to insulate the semiconductor pattern and the second metal pattern.

In the display device according to the above-described embodiments, the first crack detection line CD1, the second crack detection line CD2, the first test voltage line ML1, and the second test voltage line ML2 are formed in a gate metal pattern. In one embodiment, the first crack detection line CD1, the second crack detection line CD2, the first test voltage line ML1, and the second test voltage line ML2 may be formed in a source/drain metal pattern.

The first crack detection line CD1, the second crack detection line CD2, the first test voltage line ML1, and the second test voltage line ML2 may a metal pattern formed on one layer. In one embodiment, the first crack detection line CD1, the second crack detection line CD2, the first test voltage line ML1, and the second test voltage line ML2 may be formed on multiple layers including a first layer in a gate metal pattern and a second layer in a source/drain metal pattern.

Figure 9:
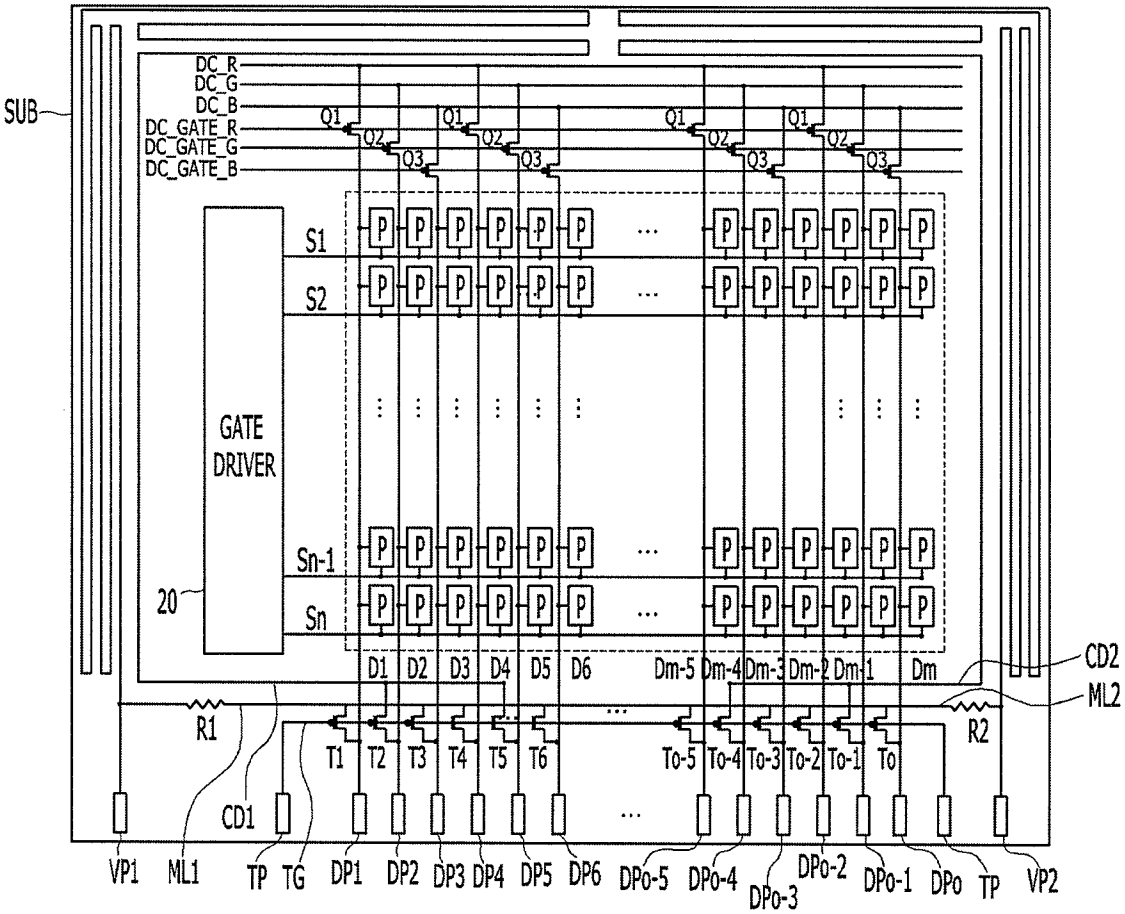
FIG. 9 illustrates another embodiment of a display device.

FIG. 9 illustrates another embodiment of a display device which has the same configuration as in FIG. 2, except for the connection structure between test transistors T1 to To, crack detection lines CD1 and CD2, and first and second test voltage lines ML1 and M2. The crack detection lines CD1 and CD2 may be between one end of some test transistors T2, T5, To-4, and To-1 from among the test transistors T1 to To and their corresponding test voltage pads VP1 and VP2.

Each of the test transistors T2 and T5 may have one end connected to the first crack detection line CD1. Each of the test transistors To-4 and To-1 may have one end connected to the second crack detection line CD2. Thus, unlike the embodiment of FIG. 2, one crack detection line may be connected to one end of two or more corresponding test transistors.

In this case, as in Equation 1, a value of T is increased and a value of m is decreased. Therefore, the value of resistors R1 or R2 may be increased compared to the embodiment of FIG. 2. When the value of the resistor R1 is increased, the value may be set by changing the form of the resistor R1 in an area of the first test voltage line ML. The first test voltage line ML1 may be in an area between the test voltage pad VP1 and one end of the test transistor T1, to provide sufficient area for the resistor R1. The value of the resistor R2 may be set in a manner similar to setting the value of resistor R1.

The display device in FIG. 9 may be driven by the signals described with reference to FIGS. 3 and 4. When the display device is cracked, data lines D1 to Dm or first and second crack lines CD1 and CD2 may be disconnected, or resistance of the data lines D1 to Dm or resistance of the first and second crack lines CD1 and CD2 may increase. For example, if data lines D2 and D5 or the first crack detection line CD1 are disconnected due to a crack in the display device, a test voltage is not supplied to the data lines D2 and D5.

In another example, if resistance of the data lines D2 and D5 or the first crack detection CD1 is increased due to a crack in the display device, the test voltage to be applied to the data lines D2 and D5 may be at a predetermined level L1 lower than the disable level because the voltage drops due to the increase in the resistance.

Figure 10:
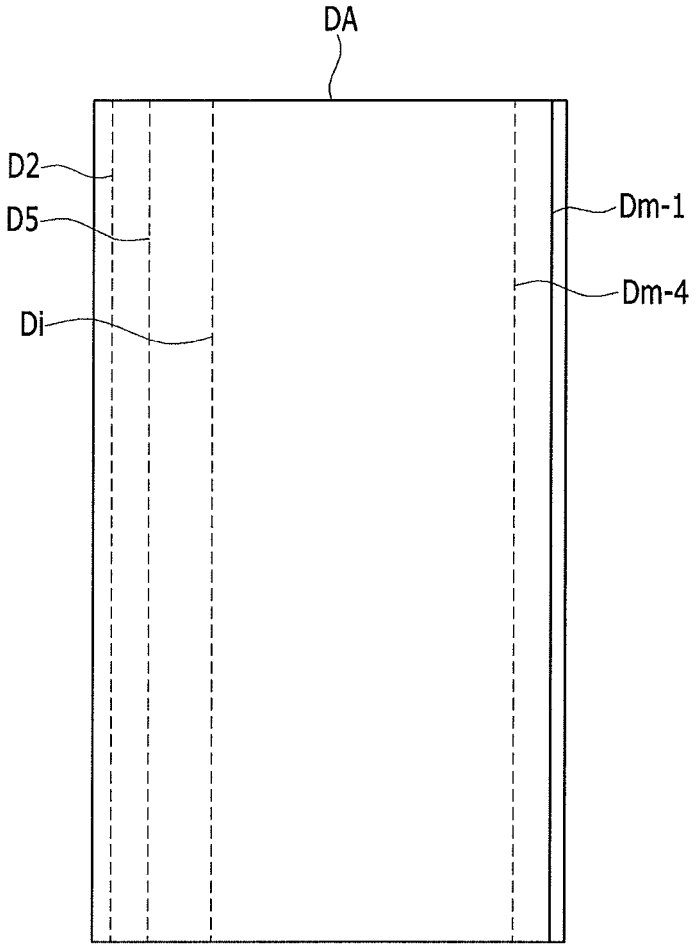
FIG. 10 illustrates a display area of another embodiment of a display device to which a test signal is applied.

FIG. 10 illustrates a display area of another embodiment of a display device to which a test signal is applied. Referring to FIG. 10, a bright line (illustrated as a dotted line) caused by the data lines D2 and D5 appears, because the pixels connected to the data lines D2 and D5 to which a test voltage is applied from the first crack detection line CD1 emit light of a white or gray grayscale level. Thus, a crack may be determined to exist in a portion of the display area which includes the first crack detection line CD1.

The data line Di connected to a test transistor Ti, which is not connected to the first and second crack detection lines CD1 and CD2, may cause a bright line (illustrated as a dotted line) to appear. Thus, the appearance of such a bright line may be determined to exists as the result of an anomaly different from a crack in the display device.

Pixels connected to a data line Dm-1, to which a test voltage is applied from the second crack voltage line CD2, display a black grayscale level. Pixels connected to a data line Dm-4, to which a test voltage is applied from the second voltage line CD2, emit light of a white or gray grayscale level. Thus, it may be determined that a portion of the peripheral area NDA, in which the second crack detection line CD2, is not cracked.

Thus, a portion of a display device, which corresponds to the crack detection line CD1, may be determined to be cracked when all the data lines D2 and D5, to which a test voltage is applied from the same crack detection line CD1, emit light of a white or gray grayscale level.

As described above, it is possible to determine whether the display device is cracked based on whether the data lines D1 to Dm are broken or whether the resistance of a crack detection line outside the display area DA changes. Thus, the display device may be determined to be cracked when a bright line appears corresponding to the crack detection line to which a test voltage is applied.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a substrate including a peripheral area around a display area;

a plurality of pixels in the display area of the substrate; and a plurality of signal lines on the substrate and connected to the pixels, wherein the signal lines include:

a plurality of data lines connected to the pixels, a crack detection line connected to at least one of first data lines, but fewer than all of the data lines, through source/drain terminals of one or more first transistors, the crack detection line in the peripheral area, a test voltage line connected to second data lines through source/drain terminals of second transistors, the first and second data lines being connected to different pixels, and a control line connected to gates of the one or more first transistors.

2. The display device as claimed in claim 1, wherein the one or more first transistors are in the peripheral area.

3. The display device as claimed in claim 2, further comprising:

a plurality of data pads in the peripheral area and connected to the data lines, each of the data pads to transfer a data voltage to be applied to the pixels, wherein the one or more first transistors are in an area between the data pads and the data lines.

4. The display device as claimed in claim 1, wherein the crack detection line is a wire that runs around the display area.

5. The display device as claimed in claim 1, wherein the crack detection line is in a zigzag pattern along one edge of the display area.

6. The display device as claimed in claim 1, wherein the crack detection line is connected to a first voltage pad that is to apply a black grayscale-level voltage.

7. The display device as claimed in claim 1, wherein the crack detection line and the data lines are on different layers.

8. The display device as claimed in claim 1, wherein the test voltage line has a resistance value corresponding to a resistance value of the crack detection line.

9. The display device as claimed in claim 1, wherein a resistance value of the test voltage line is proportional to an intensity of a resistance value of the crack detection line and a number of the first data lines and is inversely proportional to a number of the second data lines.

10. The display device as claimed in claim 1, wherein the crack detection line and the test voltage line are on a same layer.

11. The display device as claimed in claim 1, wherein the test voltage line is connected to a first voltage pad which is to apply a black grayscale-level voltage.

12. The display device as claimed in claim 1, wherein the control line are connected to gate terminals of the first and second transistors.

13. A display device, comprising:

a display area including a plurality of pixels;

a non-display area;

a crack detection line extending in the non-display area, wherein the crack detection line is connected to at least one internal data line between first and last data lines through a source/drain terminal of a first transistor, and fewer than all data lines; and a test voltage line connected to other data lines between the first and last data lines through source/drain terminals of second transistors, wherein the at least one internal data line and the other data lines are connected to different pixels.

14. The display device as claimed in claim 13, wherein the crack detection line is connected to a test voltage pad.

15. The display device as claimed in claim 13, wherein the first transistor and the second transistors have gate terminals connected to a test control pad.

16. The display device as claimed in claim 13, wherein the first transistor and the second transistors are in the non-display area.

17. The display device as claimed in claim 1, wherein the crack detection line is connected to only one of the first data lines and not to any other of the data lines.

18. The display device as claimed in claim 13, wherein the crack detection line is connected to only one internal data line and not to any other of the data lines.

19. A display device, comprising:

a substrate including a peripheral area around a display area;

a plurality of pixels in the display area of the substrate; and a plurality of signal lines on the substrate and connected to the pixels, wherein the signal lines include:

a plurality of data lines connected to the pixels, a first crack detection line connected to first data lines among the data lines through a source/drain terminal of a first transistor, the first crack detection line on substantially left side of the peripheral area, a second crack detection line connected to second data lines among the data lines through a source/drain terminal of a second transistor, the second crack detection line on substantially right side of the peripheral area, wherein the first data lines are different from the second data lines, a test voltage line connected to third data lines through source/drain terminals of third transistors, the first, second, and third data lines being connected to different pixels, and a control line connected to a gate of the first transistor.

20. The display device as claimed in claim 13, wherein a resistance value of the test voltage line is proportional to an intensity of a resistance value of the crack detection line and a number of the at least one internal data line and is inversely proportional to a number of the other data lines.

21. The display device as claimed in claim 19, wherein a resistance value of the test voltage line is proportional to an intensity of a resistance value of the first crack detection line or an intensity of a resistance value of the second crack detection line and a number of the first data lines or a number of the second data lines and is inversely proportional to a number of the third data lines.

* * * * *